United States Patent [19]

Ponican

[11] Patent Number: 5,029,800

[45] Date of Patent: Jul. 9, 1991

[54] AUXILIARY OUTBOARD MOTOR MOUNTING DEVICE

[76] Inventor: Vladimir Ponican, 27487 Bristol Dr., Warren, Mich. 48092

[21] Appl. No.: 522,154

[22] Filed: May 10, 1990

[51] Int. Cl.[5] ..... F16M 1/00; F16M 3/00

[52] U.S. Cl. ..... 248/641; 248/642

[58] Field of Search ..... 248/640, 641, 642, 643; 440/900

[56] References Cited

U.S. PATENT DOCUMENTS

| | | | |
|---|---|---|---|
| 28,176 | 10/1974 | Horton . | |
| 2,379,256 | 6/1945 | Schleisner . | |
| 2,390,135 | 12/1945 | Tobias . | |
| 2,740,602 | 4/1956 | Kloss | 248/643 |
| 2,822,142 | 5/1962 | Machlan . | |
| 3,033,500 | 5/1962 | Graves . | |
| 3,245,641 | 4/1966 | Hart . | |
| 3,333,798 | 8/1967 | Stroud . | |
| 3,861,628 | 1/1975 | Krfeger | 248/642 |
| 3,874,318 | 4/1975 | Langley | 248/642 |
| 3,948,204 | 4/1976 | Brock et al. . | |
| 3,965,844 | 6/1976 | Brock et al. . | |
| 4,025,010 | 5/1977 | Soot | 248/641 |
| 4,077,353 | 3/1978 | Webb . | |
| 4,094,482 | 6/1978 | Weaver . | |
| 4,154,417 | 5/1979 | Foley . | |
| 4,410,161 | 10/1983 | Booty | 248/642 |
| 4,875,656 | 10/1989 | Boede | 248/642 |

*Primary Examiner*—Robert L. Wolfe

*Attorney, Agent, or Firm*—Brooks & Kushman

[57] ABSTRACT

A device for mounting an auxiliary outboard motor on the swim platform of a water craft to allow the motor to be pivoted between an extended position aft of the swim platform when in use, and a compact stowed position when not in use.

12 Claims, 2 Drawing Sheets

AUXILIARY OUTBOARD MOTOR MOUNTING DEVICE

TECHNICAL FIELD

This invention relates to a device for mounting an auxiliary outboard motor on the swim platform of a water craft.

BACKGROUND OF INVENTION

It is common for pleasure craft to be equipped with swim platforms extending from the stern of the craft. A swim platform is sometimes used by boaters to mount an auxiliary outboard motor for trolling or other low speed operations.

The mounting of an outboard motor directly to the swim platform extends the effective length of the water craft and increases the clearance needed for docking. Also, the outboard motor is vulnerable to impact and difficult to access (e.g., to remove propeller fouling by weeds or the like) when mounted directly to the swim platform.

U.S. Pat. No. 2,390,135 to Tobias discloses a swivel bracket which enables the propeller end of an outboard motor to be raised out of the water and then to be swung in a horizontal plane. The swivel bracket is intended to be clamped to the outboard motor's driveshaft housing. Recent configurations have flared driveshaft housings which no longer accept such a bracket. Adapting this invention for use with modern motors would require additional labor and materials. Constant modification is necessary to keep pace with changes and improvements in outboard motors.

U.S. Pat. No. 2,740,602 to D. D. Kloss and U.S. Pat. No. 3,333,798 to R. D. Stroud each disclose an outboard motor mounting clamp which is a modification of a conventional transom clamp. Both require removal of the existing transom clamp and adjustment prior to installation of the invention. A new mounting clamp is necessitated for every change in model year and manufacturer. In addition, these mounting clamps do not prevent the motor from extending beyond the stern of the water craft in the stowed position.

U.S. Pat. No. 4,077,353 to Webb, Jr. discloses a motor mount for a water craft which is pivotally affixed to the stern of a water craft enabling a pivoting motion around the vertical axis. In the stowed position, the motor is in a horizontal position parallel to the stern of the water craft. This configuration increases the length of the water craft and the likelihood of damage upon maneuvering in tight quarters.

U.S. Pat. Nos. 3,245,641, 3,033,500 and 3,032,304 issued to H. H. Hart, E. B. Graves, and H. A. Machlan respectively all disclose adjustable retracting outboard motor brackets enabling easy vertical movement of an auxiliary outboard motor. These inventions do not enable pivotal movement of a motor for stowage. In addition, even in the elevated (stowed) position these inventions increase the length of the water craft thereby decreasing maneuverability and increasing the likelihood of motor damage from collision.

U.S. Pat. No. 2,822,142 to R. G. Collins discloses an outboard motor bracket which extends the motor away from the stern of the water craft eliminating the danger of fire resulting from oil and gas leakage from the motor into the water craft. The bracket enables horizontal pivoting of the motor adjacent to the stern of the water craft in order to remove weeds or service the motor.

Such a configuration adds rather than decreases the length of the water craft. In the stowed position the motor is still subject to damage because of its location laterally adjacent to the water craft rather than being contained within the water craft's peripheral boundary.

U.S. Pat. No. 2,379,256 to G. W. Shleisner discloses an outboard motor support consisting of a bracket which permits an outboard motor to be shifted to various positions allowing the water craft to be propelled sternward and to allow the driveshaft to be lifted clear of the water. This arrangement requires altering the stern of the water craft to enable the bracket to be affixed. In the stowed position the motor housing protrudes beyond the stern of the water craft making it susceptible to damage.

U.S. Pat. No. 4,154,417 to Foley, Jr., U.S. Pat. No. 4,094,482 to Weaver, U.S. Pat. No. 28,176 to G. F. Horton, U.S. Pat. No. 3,948,204 to Brock et al., and U.S. Pat. No. 3,965,844 to Brock et al. are included as additional references which do not directly relate to the present invention. Specifically, these inventions relate to bow mounted auxiliary motors which allow only hinged movement to raise and lower a motor into and out of the water. These patents do not enable horizontal pivotal movement once the motor is clear of the water.

DISCLOSURE OF INVENTION

The present invention addresses the concerns of a direct mounting of an auxiliary outboard motor to the swim platform by providing a mounting device which facilitates pivotal movement of the motor between an extended position aft of the swim platform for operation, and a compact stowed position. In the stowed position, the motor is within the envelope of the swim platform, and accessible to the operator.

In the preferred embodiment, the mounting device of the present invention includes a substantially vertical mounting flange adapted to receive a conventional transom clamp to secure the outboard motor. The mounting flange is secured to a base plate which in turn attaches to the swim platform. The attachment of the base plate to the swim platform provides for horizontal rotational movement of the outboard motor between the extended position and the stowed position. In the extended position the motor is ready for service in the water to propel the craft. In moving to the stowed position, the motor is rotated 90° in a vertical plane removing the motor from the water through the normal pivotal connection between the transom clamp and the motor housing. Then horizontally rotating the motor parallel to the water surface by pivoting the mounting device. The order of movement is determined by motor positioning and clearances, and reverse ordering could be practicable as well.

Accordingly, it is an object of the present invention to provide a mounting device for an auxiliary outboard motor with the advantages of being relatively simple in design and construction, which can be attached or removed to a swim platform without difficulty or otherwise altering the structure of the water craft forward of the swim platform.

It is another object of the present invention to provide an improved mounting device so that the auxiliary outboard motor is less prone to damage during docking and other maneuvers and more accessible to the operator for servicing.

A further object of the present invention is to provide an improved mounting device which cooperates with a conventional transom clamp avoiding the necessity of altering or replacing manufacturer's components to secure the auxiliary motor to a swim platform of a water craft.

Also an object of the present invention is to provide an improved mounting device which allows the use of existing shorter motor shafts because of the lower mounting location.

An additional object of the present invention is to provide an improved mounting device which limits horizontal rotation in either direction toward the stern of the water craft to prevent damage to the motor components or the water vessel caused by over pivoting the motor.

A further object of the present invention is to provide an improved mounting device so that the pivotal means is clamp secured in the stowed and operating positions to reduce vibrations during operation of the water craft.

It is another object of the present invention to provide an improved mounting device so that the pivotal means is prevented from disengagement with the base mounting means. The auxiliary motor may be chained or otherwise secured to the mounting flange, thereby deterring theft or otherwise loss of the auxiliary motor.

An additional object of the present invention is to provide an improved mounting device which moves from the stowed to an operating position with relative ease.

A specific object of the present invention is to provide a mounting device for an auxiliary outboard motor on a swim platform of a water craft wherein the auxiliary motor is pivotally attached by a transom clamp so that the motor may be raised and lowered. The device includes a substantially vertical mounting flange adapted to receive a transom clamp to secure the auxiliary motor. The base plate of the device is attached to the swim platform for supporting the mounting flange on the swim platform. The pivot means for the device connects the base plate and the mounting flange to facilitate the pivotal movement of the auxiliary motor between an operating position sufficiently overhanging the swim platform so that the auxiliary motor can be lowered beside the swim platform. In the stowed position the auxiliary motor is sufficiently raised to overlay the swim platform so the auxiliary motor can be compactly stowed on top of the swim platform.

Another specific object of this invention is to provide an improved method of mounting an auxiliary outboard motor to the swim platform of water craft for selectively operating or stowing the motor. The steps of the method include securing a bracket to the swim platform for pivotal movement in a horizontal plane between the stowed and the operating positions. Securing the outboard motor to the bracket for pivotal movement in a vertical plane between a raised position for stowing and a lowered position for operating. Also pivotally mounting the outboard motor to its lowered position only after the bracket has been pivotally moved to its operating position and locked in place. Finally, pivotally moving the bracket to its stowed position and locked in place only after the outboard motor has been pivotally mounted to its raised position.

The invention, together with additional features and advantages thereof, may best be understood by reference to the following description taken in connection with the accompanying illustrative drawings.

BEST MODE OF THE INVENTION

Figure 1:
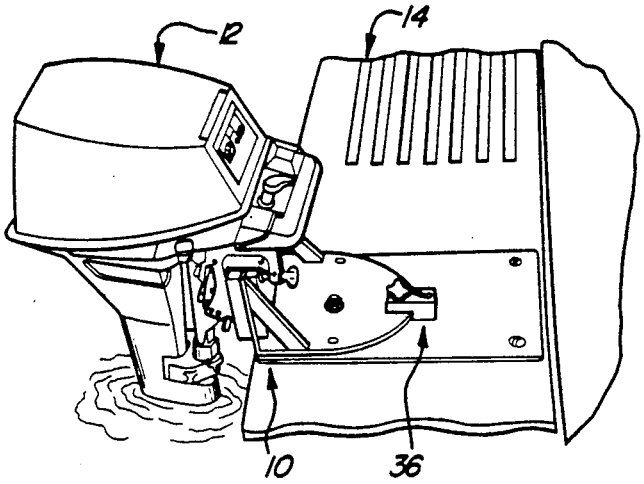
FIG. 1 is an elevated view from the starboard side of a water craft showing an auxiliary outboard motor mounted on the device of the present invention in an extended position aft of the swim platform for operation of the motor.
Figure 2:
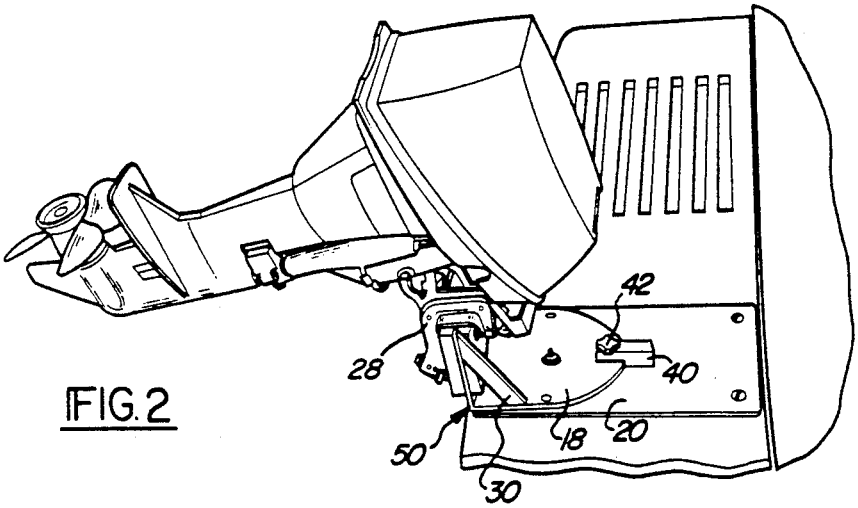
FIG. 2 is a like elevational view showing the auxiliary outboard motor raised from the water.
Figure 3:
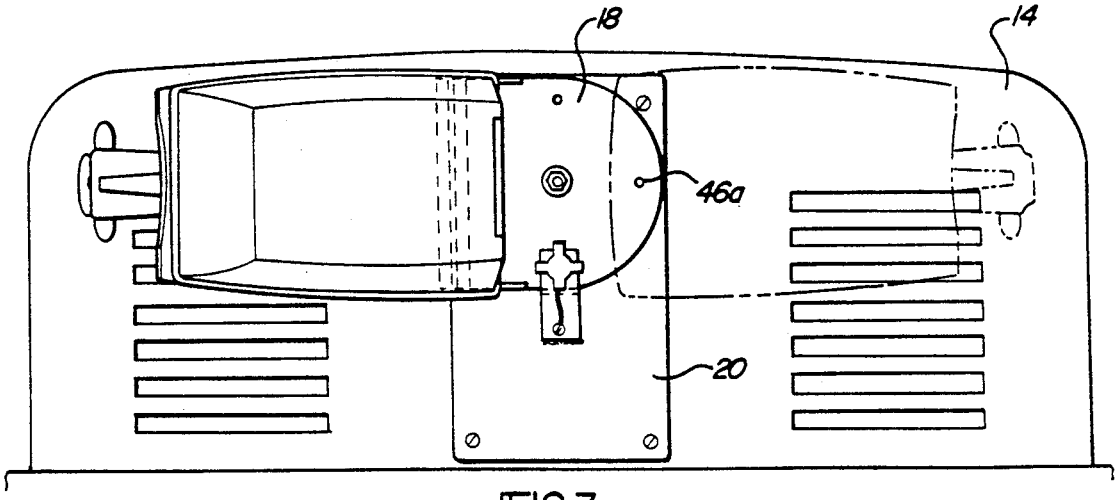
FIG. 3 is a like elevational view showing the auxiliary motor pivoted into its stowed position within the envelope of the swim platform.
Figure 4:
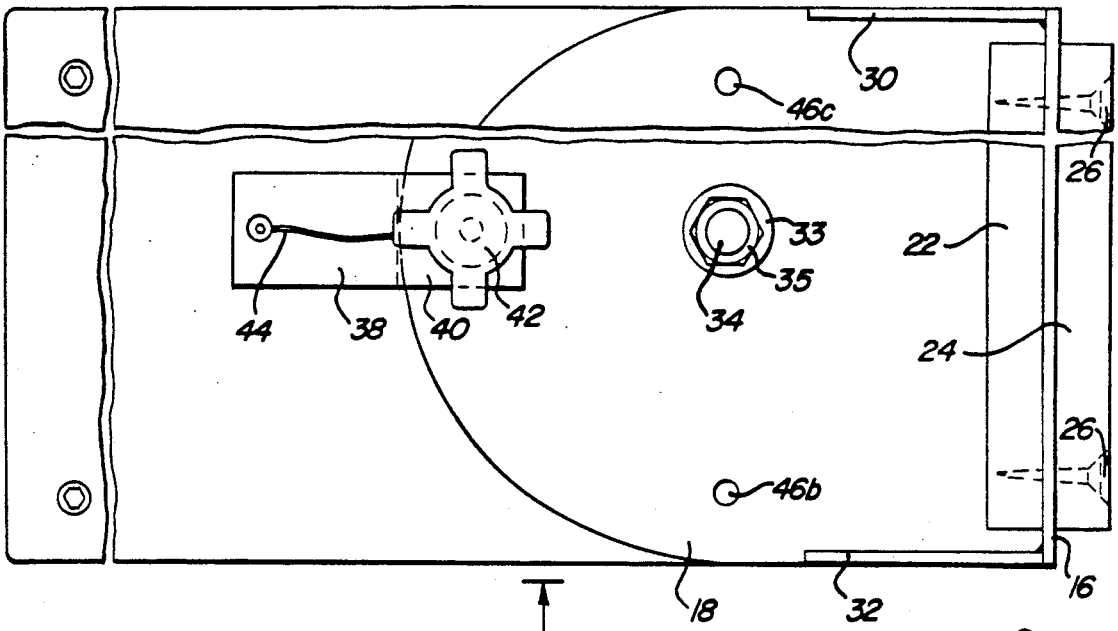
FIG. 4 is a plan view of the device showing the alignment of the base plate and pivot means when the motor is in operating position.
Figure 5:
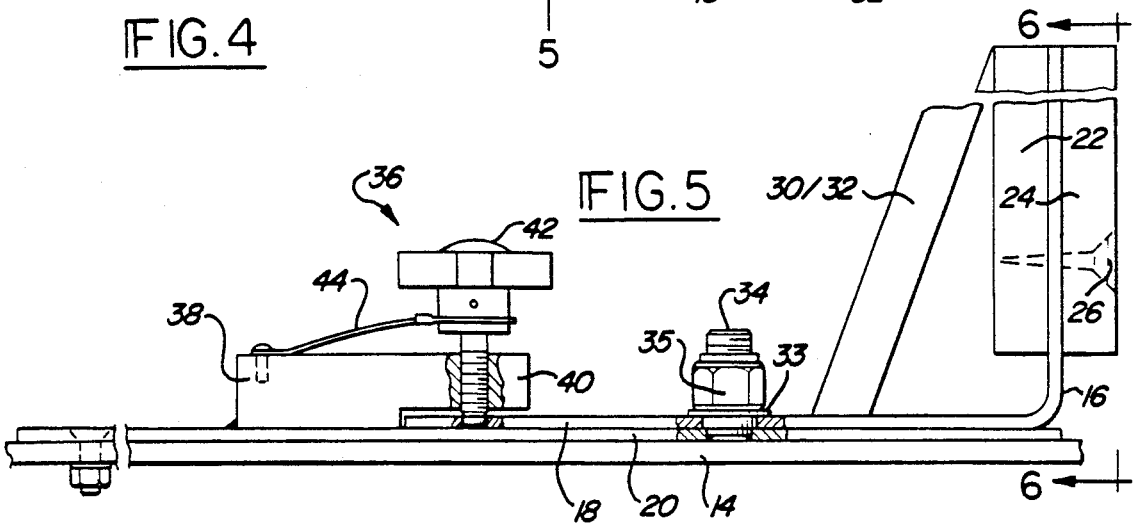
FIG. 5 is a side view of the device while in the same alignment as in FIG. 4 and 5 showing the fastening means.
Figure 6:
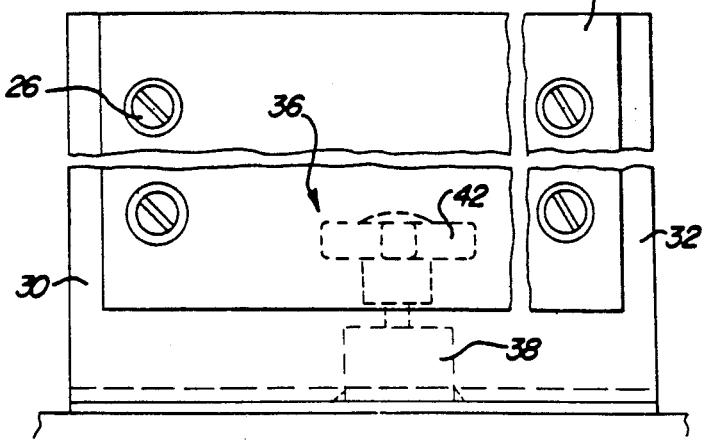
FIG. 6 is an end view of the device seen facing the stern showing the alignment when the motor is in operating position.
Figure 5A:
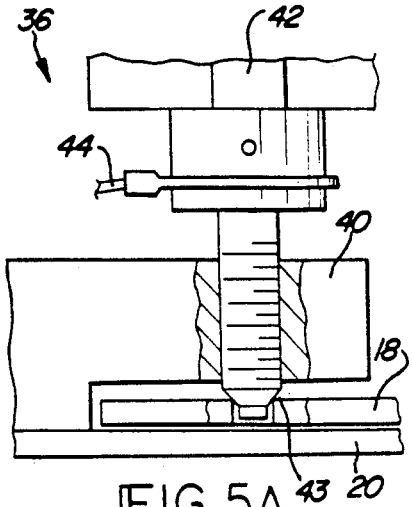
FIG. 5*a* is a fragmentary side view of the device showing the locking screw and hole configuration of the locking means.

The embodiment in FIGS. 1 through 6 show an auxiliary motor mount 10 for mounting an auxiliary motor 12 to a swim platform 14 having a subassembly 50 and a base plate 20.

Subassembly 50 is comprised of a substantially vertical mounting flange 16 and a pivot member 18. Clamp pads 22, 24 are fastened to the mounting flange 16 by conventional means, such as screws 26, to allow a conventional transom clamp 28 to be secured. Support braces 30, 32 are fastened at opposite ends to the lateral portions of mounting flange 16 and the pivot member 18 for added support. A center bolt 34 fastens the pivot member 18 to the base plate 20 to enable the pivot member 18 horizontal rotation relative to the base plate 20. The transom clamp 28 may be additionally chained to the support braces 30 and 32 and the transom itself.

A locking member 36 having generally a rectangular body 38 and a longitudinal protrusion 40 is affixed to the base plate 20 in parallel alignment therewith, such that the longitudinal protrusion 40 partially extends over pivot member 18. A locking screw 42 is threadily affixed and centrally located in the longitudinal protrusion 40. A security strap 44 is affixed at opposite ends to the locking screw 42 and the rectangular body 38 preventing the locking screw 42 from being lost if completely removed from the longitudinal protrusion 40.

A locking screw 42 cooperates with holes 46*a*, 46*b*, 46*c* located in longitudinal alignment with the pivot member 18. The locking screw 42, when inserted, prevents pivotal movement of the pivot member 18 relative to the base plate 20. The locking screw 42, when released, allows the pivot member 18 to horizontally rotate the auxiliary motor 12, in the horizontal position, from the stowed position on the swim platform 14 to the operating position aft of the swim platform 14 or from the operating position to the stowed position. The auxiliary motor 12 may be stowed toward the starboard or port side.

The pivot member 18 having generally a rectangular shape where it abuts mounting flange 16 and along its sides. The pivot member 18 has a generally radial shape at the end which travels underneath the longitudinal protrusion 40 of locking member 36. The braces 30 and 32 contact the locking member 36 to prevent over rotation of the subassembly 50.

The base plate 20 is fastened to the swim platform 14 by conventional means such as screws or bolts. To secure the base plate 20 to the swim platform 14, it is only necessary to alter the swim platform 20 to accommodate conventional fasteners.

The center bolt 34 pivotally secures the pivot member 18 to the base plate 20. The center bolt 34 is weldedly fastened to base plate 20. A locking nut 35 and washer 33 secure the pivot member 18 to the base plate 20 in pivotal engagement. Three holes **46*a*, 46*b*, 46*c* are made into the pivot member 18 enabling locking member 36 to secure the auxiliary motor 12** in one of three positions.

The locking member 36 may be secured to the base plate 20 after the subassembly 50 has been placed in position in the manner shown (such as welding) to prevent disengagement or removal of the subassembly 50. In this manner the pivotal member 18 cannot be disengaged from the center bolt 34.

Locking screw 42 is released to enable pivot member 18 to horizontally rotate on base plate 20. The locking screw is tightened to locate and lock pivot member 18 to base plate 20 in either the stowed or the operating position.

The auxiliary motor 12 connected to the transom clamp 28 is secured to the clamp pads 22, 24 of the mounting flange 16. The auxiliary motor 12 can then be pivoted vertically into the water by means of the transom clamp 28 (FIG. 1). To store, the auxiliary motor 12 is raised out of the water by vertically pivoting the auxiliary motor 12 on the transom clamp 28 (FIG. 2), releasing the locking screw 42 and pivoting subassembly 50 relative to base plate 20, to a position to the stern of the water craft completely within the envelope of the swim platform 14 (FIG. 3) and then securing locking screw 42 into holes **46*b* or 46*c* to secure the auxiliary motor 12 in the stowed position on swim platform 14. A chamfered end 43 of locking screw 42 clamps the subassembly when secured by locking screw 42** to reduce vibration in both the stowed and operating positions.

While it is preferred to mount the device at the center line of the water craft, the device may be mounted toward the starboard or port side of the swim platform as desired.

While the best mode for carrying out the invention has been described in detail, those familiar with the art to which this invention relates will recognize various alternative designs and embodiments for practicing the invention as defined by the following claims.

What is claimed is:

1. A device for mounting an auxiliary outboard motor on a generally horizontal swim platform of a boat wherein the auxiliary motor is pivotally attached by a transom clamp so that the motor can be raised and lowered, said device comprising:

a substantially vertical mounting flange adapted to receive the ransom clamp for securement of the auxiliary motor;

plate means attachable to the swim platform, for supporting the mounting flange on the swim platform; and pivot means connecting the plate means and the mounting flange for relative pivotal movement about a vertical axis for facilitating the pivotal movement of the auxiliary motor between an operating position sufficiently overhanging the swim platform that the auxiliary motor can be lowered beside the swim platform, and a stowed position sufficiently overlaying the swim platform when the auxiliary motor is raised and pivoted about the vertical axis that the auxiliary motor can be compactly stowed on top of the swim platform with relative ease without further raising the auxiliary motor.

2. The device of claim 1 wherein the mounting flange includes at least one clamp pad as a means to receive a transom clamp.

3. The device of claim 2 wherein the mounting flange has a fastening means for mounting the clamp pad.

4. The device of claim 1 in combination with the swim platform of a boat wherein the plate means is secured to the swim platform by fastening means.

5. The device of claim 1 further including a locking means for preventing the relative pivotal movement of the mounting flange with respect to said plate means between said operating and stowed positions.

6. The device of claim 5 wherein the locking means includes clamp means to reduce vibration of the auxiliary motor in the operating and stowed positions.

7. The device of claim 1 further including means to prevent the over rotation of the auxiliary motor.

8. A method of mounting an auxiliary motor having a transom clamp to a swim platform, the method comprising the steps of:

providing a mounting flange adapted to receive the transom clamp of the auxiliary motor;

providing a support means enabling pivoting of the mounting flange about a vertical axis when the transom clamp of the auxiliary motor is received thereon;

securing the support means to the swim platform; and securing the auxiliary motor to the mounting flange by the transom clamp.

9. The method of claim 8 wherein the step of securing the auxiliary motor to the mounting flange includes fastening at least one clamp pad to the mounting flange to enable securing of the transom clamp.

10. The method of claim 8 wherein the step of providing the support means enables the mounting flange to pivot horizontally, and is prevented from over rotation.

11. The method of claim 8 including the further step of providing a locking and clamping means to prevent the horizontal pivoting and vibration of the mounting flange;

12. The method of mounting an outboard motor to the swim platform of a water craft for selectively operating or stowing in the outboard motor and comprising the steps of:

securing a bracket to the swim platform for pivotal movement in a horizontal plane about a vertical axis between stowed and operating positions;

securing the outboard motor to the bracket for pivotal movement in a vertical plane between a raised position for stowing and a lowered position for operating;

pivotally moving the outboard motor to its lowered position only after the bracket has been pivotally moved within a horizontal plane to its position for pivotal movement in a vertical plane; and pivotally moving the bracket to its stowed position within the horizontal plane about the vertical axis only after the outboard motor has been pivotally moved to its raised position.

* * * * *